US006527687B1

(12) United States Patent
Fortney et al.

(10) Patent No.: US 6,527,687 B1
(45) Date of Patent: Mar. 4, 2003

(54) PRESSED PAPER CUT-IN-PLACE DIE

(75) Inventors: Joe Lynn Fortney, Jonesboro, IN (US); Jeffrey Colin Reasinger, Hilliard, OH (US); Garold W. Alexander, Lewis Center, OH (US)

(73) Assignee: Peerless Machine & Tool Corporation, Marion, IN (US)

( * ) Notice: Subject to any disclaimer, the term of this patent is extended or adjusted under 35 U.S.C. 154(b) by 0 days.

(21) Appl. No.: 09/555,439

(22) PCT Filed: Dec. 1, 1998

(86) PCT No.: PCT/US98/25434

§ 371 (c)(1),
(2), (4) Date: May 31, 2000

(87) PCT Pub. No.: WO99/28118

PCT Pub. Date: Jun. 10, 1999

Related U.S. Application Data

(60) Provisional application No. 60/067,425, filed on Dec. 3, 1997.

(51) Int. Cl.[7] ..... B31B 1/114

(52) U.S. Cl. ..... 493/56; 493/142; 493/167

(58) Field of Search ..... 493/51, 56, 143, 493/142, 167, 170; 53/561

(56) References Cited

U.S. PATENT DOCUMENTS

| | | | | |
|---|---|---|---|---|
| 308,908 | A | | 11/1884 | Robertson |
| 945,874 | A | | 1/1910 | Thompson |
| 1,047,373 | A | | 12/1912 | Bond |
| 1,844,500 | A | | 2/1932 | Dailey |
| 2,492,886 | A | | 12/1949 | Punte |
| 3,550,421 | A | | 12/1970 | Stakel |
| 3,983,827 | A | | 10/1976 | Meadors |
| 4,026,458 | A | | 5/1977 | Morris et al. |
| 4,127,378 | A | | 11/1978 | Meadors |
| 4,143,587 | A | * | 3/1979 | Fujii |
| 4,149,841 | A | | 4/1979 | Patterson |
| 4,228,121 | A | | 10/1980 | Meadors |
| 4,242,293 | A | | 12/1980 | Dowd |
| 4,246,223 | A | | 1/1981 | Patterson |
| 4,435,143 | A | | 3/1984 | Dempsey |
| 4,456,164 | A | | 6/1984 | Foster et al. |
| 4,484,703 | A | * | 11/1984 | Kawasaki et al. |
| 4,497,620 | A | | 2/1985 | Dempsey |
| 4,637,811 | A | * | 1/1987 | Fortney |
| 4,642,086 | A | | 2/1987 | Howarth, Jr. |
| 4,691,604 | A | | 9/1987 | Carmichael |
| 4,755,128 | A | | 7/1988 | Alexander et al. |
| 4,778,439 | A | | 10/1988 | Alexander |
| 4,936,815 | A | * | 6/1990 | Kirkland et al. |
| 5,041,071 | A | | 8/1991 | Reasinger et al. |
| 5,052,992 | A | | 10/1991 | Hyder |
| 5,087,236 | A | | 2/1992 | Morimoto |
| 5,098,363 | A | | 3/1992 | Reasinger et al. |
| 5,129,874 | A | | 7/1992 | Hayes, III et al. |
| 5,140,882 | A | | 8/1992 | Hyder |
| 5,230,939 | A | | 7/1993 | Baum |
| 5,319,910 | A | | 6/1994 | Takata et al. |
| 5,496,250 | A | | 3/1996 | Fielder et al. |
| 5,577,989 | A | | 11/1996 | Neary |
| 5,904,643 | A | | 5/1999 | Seeberger et al. |
| 6,174,274 | B1 | * | 1/2001 | Hawkins et al. |

FOREIGN PATENT DOCUMENTS

| | | |
|---|---|---|
| EP | 0683 035 A1 | 4/1995 |
| WO | WO 90/14993 | 5/1989 |

* cited by examiner

*Primary Examiner*—Eugene Kim
(74) *Attorney, Agent, or Firm*—Barnes & Thornburg

(57) ABSTRACT

A die system (10) for cutting a piece of sheet stock (11) to create a blank and forming the blank to create a container includes first and second mating die halves (56, 96) and a cutting punch (68). The first and second mating die halves (56, 96) are configured to move together to form the container from the blank. The cutting punch (68) extends about the first die half (56) and is movable therewith. The cutting punch (68) is configured to cut the piece of sheet stock (11) to create the blank. Movement of the die halves (56, 96) together causes the cutting punch (68) to cut the blank from the piece of sheet stock (11) and further movement of the die halves (56, 96) together causes the first and second die halves (56, 96) to form the container from the blank.

5 Claims, 9 Drawing Sheets

PRESSED PAPER CUT-IN-PLACE DIE

CROSS-REFERENCES TO RELATED APPLICATIONS

This application is a U.S. national counterpart application of international application serial No. PCT/US98/25434 filed Dec. 1, 1998, which claims priority to U.S. provisional application serial No. 60/067,425 filed Dec. 3, 1997.

BACKGROUND AND SUMMARY OF THE INVENTION

The present invention relates to pressed paperboard forming machines, and particularly to pressed paper cut-in-place dies for forming paper containers and the like.

Most of the pressed paperboard forming machines currently in production consist of one of three processes. In the first, the paperboard blank is precut on a separate machine and the stack of blanks are then placed into a hopper on the forming machine whereby they are then fed one at a time into a forming section. In the forming section, the blank is docked against physical stops which centers the blank over matched, metal male and female die halves. The top die which is usually the male die then descends engaging the paper and forcing it into the female cavity. The male die presses the paperboard against the female die for a period of time, then begins to ascend to an open position. An ejector mechanism in the female die lifts the container out of the female die and because the female die is on an acute angle, the container falls out of the die and press onto a conveyor. In some machines in the past, the dies have been arranged to form the paper plate or container upside down.

In the second system, a web of paperboard is unwound from a a roll and fed into a press comprised of three sections; a feed or metering section, a cutting or blanking section, and a forming section. In this type system, the feed section meters the paperboard into the cutting section over a female cavity or hole. The top platen which contains male punches that match the size of the female cavity or hole in the bottom then descends and shears the paperboard blanks from the web. The blanks then drop through the hole and are transferred to the forming section by sliding via gravity on rails set to 45° angles. In the forming section, the blank is docked against physical stops which centers the blank over matched, metal male and female die halves. The top die which is usually the male die then descends engaging the paper and forcing it into the female cavity. The male die presses the paperboard against the female die for a period of time, then begins to ascend to an open position. An ejector mechanism in the female die lifts the container out of the female die and because the female die is on a 45° angle, the container falls out of the die and press onto a conveyor.

The third system consists of feeding a web of paperboard into a cutting section that utilizes a steel rule die to cut and crease the blanks simultaneously. Although the blanks have been cut from the web, they are still attached to the web by small nicks in the paperboard. The paper is then indexed with the blank intact until it exits the cutting section. As the web with the pre-cut blank exits the cutting section, a set of rollers picks up the blank and strips it from the web. The scrap exits the bottom of the machine and is cut into pieces as the blank is urged by the rollers into the forming die section. In the forming section, the blank is docked against physical stops which centers the blank over matched, metal male and female die halves. The top die which is usually the female die then descends engaging the paper and forcing it around the male die. The female die presses the paperboard against the male die for a period of time, then begins to ascend to an open position. As the press begins to open, the draw ring surrounding the male die follows the press upward stripping the part from the male die. When the part has been lifted to the point of clearing the male die, the draw ring is restrained from further travel and the part is blown off the ring and onto a conveyor by strategically placed air jets.

According to the present invention, a die system for cutting a piece of sheet stock to create a blank and forming the blank to create a container includes first and second mating die halves and a cutting punch. The first and second die halves are configured to move together to form the container from the blank. The cutting punch extends about the first die half and is movable therewith. The cutting punch is configured to cut the piece of sheet stock to create the blank. Movement of the die halves together causes the cutting punch to cut the blank from the piece of sheet stock and further movement of the die halves together causes the first and second die halves to form the container from the blank.

In preferred embodiments, the first die half is a female die half and the second die half is a male die half. The female and male die halves are positioned substantially horizontally with the female die half being positioned vertically above the male die half. The male die half is stationary so that the female die half moves vertically downwardly to mate with the male die half to form the container and vertically away from the male die half to release the container from between the female and male die halves.

The die system may also include a draw ring extending about the male die half. The draw ring is movable with the female die half relative to the male die half so that the blank is held between the draw ring and a perimetal surface of the first die half as the container is being formed. The die system may also include a stripper ring extending about the cutting punch and movable with the first die half. The stripper ring is configured to hold the piece of sheet stock in place as the sheet stock is being cut and the blank is being formed. The die system may also include a cutting ring extending about and spaced-apart from the second die half and positioned to lie opposite the stripper ring. The cutting ring is configured to cooperate with the stripper ring to hold the sheet stock between the stripper ring and the cutting ring. The cutting ring is also configured to allow the cutting punch to extend between the second die half and the cutting ring to cut the sheet stock.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the following figures in which:

FIG. 3 is an enlarged view of a portion of the die system of FIGS. 1 and 2 showing a piece of sheet stock positioned between the male die half and the female die half with the female die half positioned in spaced-apart relation to the male die half;

FIG. 4 is a view similar to FIG. 3 showing movement of female die half downwardly toward the male die half such that the piece of sheet stock is held between a perimetal surface of the female die half and a draw ring extending about the male die half and is also held between a stripper ring extending about the female die half and a cutting ring extending about the draw ring;

FIG. 5 is a view similar to FIGS. 3 and 4 showing further movement of the female die half toward the male die half causing a cutting punch extending about the female die to cut the piece of sheet stock between the draw ring and the cutting ring to create the blank and an outer perimetal portion of the blank being held between the perimetal surface of the female die half and the draw ring with the draw ring being slightly compressed by the female die half to cause the draw ring to move downwardly with the female die half relative to the male die half;

FIG. 6 is a view similar to FIGS. 3–5 showing further movement of the female die half toward the male die half causing the female and male die halves to press together to form the blank into the container and showing the outer perimetal portion of the container being held between the perimetal surface of the female die and the draw ring with the draw ring being further compressed by the female die half to cause the draw ring to move further downwardly;

DETAILED DESCRIPTION OF THE DRAWINGS

Figure 1:
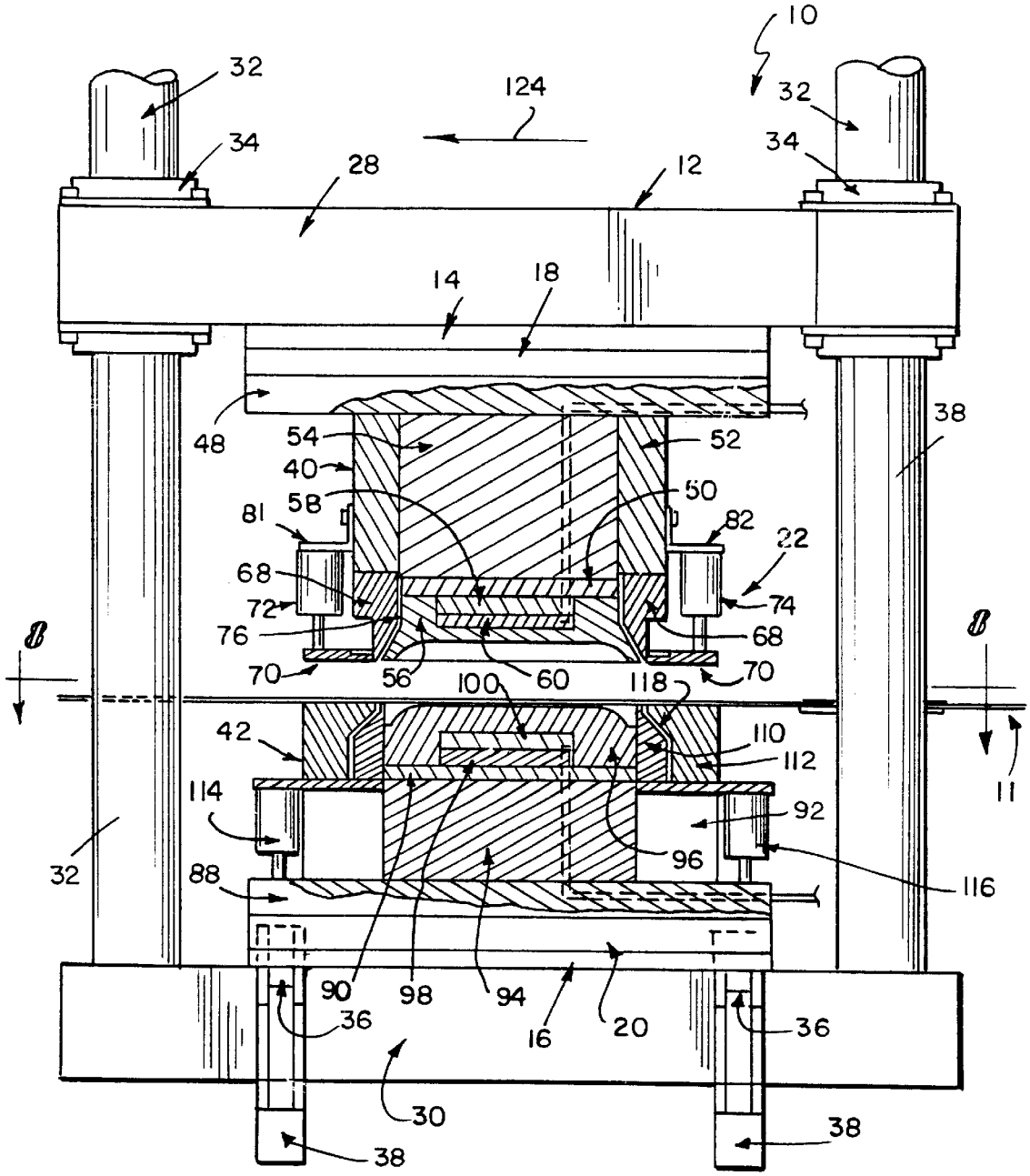
FIG. 1 is a side view of a die system in accordance with the present invention showing the die system having a frame and a pair of female and male mating die halves mounted to the frame, the female and male die halves being configured to receive a piece of sheet stock such as paperboard therebetween so that the die halves can move together to cut the sheet stock to create a blank and form the blank to create a container.
Figure 2:
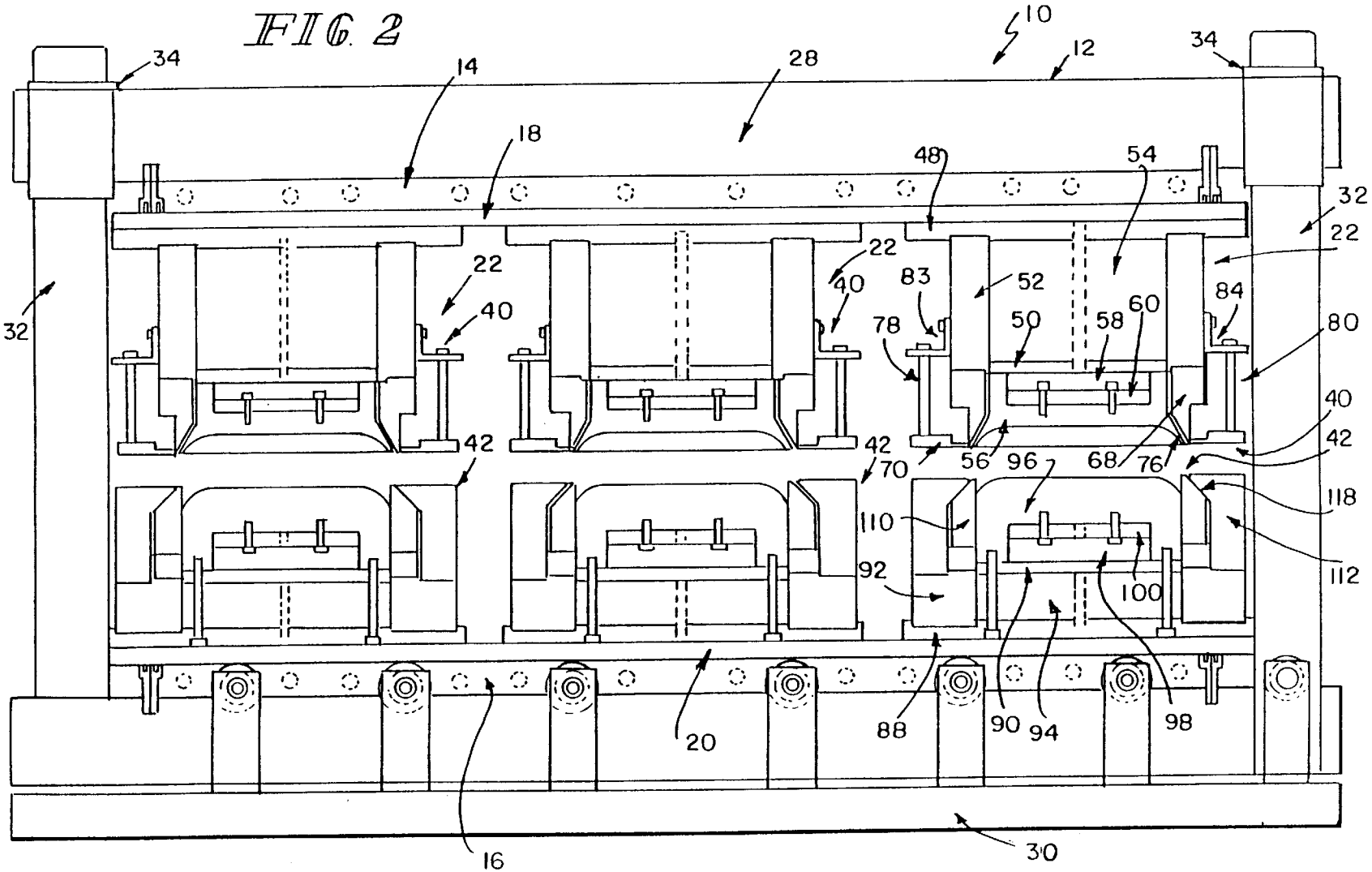
FIG. 2 is a front view of the die system of FIG. 1 showing the die system having three sets of female and male mating dies wherein three female die halves are mounted to an upper section of the frame and three male die halves are mounted to a lower section of the frame.

Referring now to the drawings, FIGS. 1 and 2 illustrate a die system 10 for cutting and forming a piece of sheet stock 11 in a single-press action to create one or more containers. Sheet stock 11 may be, for example, Solid Bleached Sulfate (SBS) paperboard between 0.001–0.024 inch (0.0254–0.6096 mm), although other sizes and types of sheet stock may be used. The sheet stock 11, for example, may be recycled paperboard, multiple webs of material, single-sided corrugated paperboard, or any other sheet stock from which a container may be made. In addition, the containers that are made from sheet stock 11 can be any shape or size including circular or rectangular containers for containing sandwiches or the like.

As shown in FIG. 1, die system 10 includes a frame (or die set) 12, a pair of upper and lower cooling plates 14, 16, a pair of upper and lower master mount plates 18, 20, and at least one cutting/forming die 22. Frame 12 includes an upper die shoe 28 for mounting of the upper die parts (described below), a lower die shoe 30 for mounting of the lower die parts (described below), and a set of four of die posts 32 and four die post bushings 34 for connecting the upper die shoe 28 to the lower die shoe 30. The upper die shoe 28 and all the upper die parts mounted to it reciprocate up and down on the die posts 32 using the die post bushings 34 as a linear bearing. The lower die shoe 30 and all the lower die parts mounted to it preferably remain stationary, although it is understood that either die shoe could move with the other being stationary or both die shoes could move together to cut and form a container in accordance with the present invention. Die post bushings 34 are pressed into bored holes in the upper die shoe 28. Die posts 32 are pressed into bored holes in the lower die shoe 30. Frame 12 also includes a plurality of die lift bearings 36 mounted to a plurality of die lifting cross members 38, as shown in FIGS. 1 and 2, which allow the upper and lower die parts to be easily removed from frame 12 as discussed below.

Upper and lower cooling plates 14, 16 are mounted to upper and lower die shoes 28, 30, respectively, as shown in FIG. 1. Upper and lower cooling plates 14, 16 substantially span the width and length of the upper and lower die shoes 28, 30, as shown in FIGS. 1 and 2. Temperature controlled liquid circulates through the upper and lower cooling plates 14, 16 to keep the upper die shoe 28 at a temperature consistent with the lower die shoe 30. This minimizes or eliminates heat expansion of the upper die shoe 28 relative to the lower die shoe 30 as the upper die shoe 28 reciprocates on the die posts 32.

Upper and lower master mount plates 18, 20 are mounted to upper and lower cooling plates 14, 16, respectively. Upper and lower master mount plates 18, 20 substantially span the width and length of the upper and lower cooling plates 14, 16, as shown in FIGS. 1 and 2. The upper and lower master mount plates 18, 20 and the upper and lower cooling plates 14, 16 preferably remain mounted to one another and to the frame 12 when an individual die 22 needs to be changed or disconnected from die system 10 for maintenance, replacement, or the like. However, the upper and lower master mount plates 18, 20 and all the dies 22 mounted to it may also be removed when the entire set of dies 22 mounted to master mount plates 18, 20 need to be changed or serviced. For example, die lifting bearings 36 project through cutouts in the lower die shoe 30 and lower cooling plate 16 to allow the upper and lower master mount plates 18, 20 and connected cutting/forming dies 22 to be lifted up and rolled out of the press on the die lifting bearings 36 when die lift bearings 36 and cross member 38 are urged upwardly by a lifting force and the master mount plates 18, 20 are unbolted from their respective die shoes 28, 30. Thus, upper and lower master mount plates 18, 20 allow dies 22 to be changed individually or as a complete set.

Each die 22 includes an upper die section 40 and a lower die section 42 mounted to upper and lower master mount plates 18, 20, respectively, as shown in FIGS. 1 and 2. Each upper die section 40 of each die 22 includes a mounting flange 48, a backing plate 50 spaced-apart from mounting flange 48, and a backing ring 52 interconnecting mounting flange 48 and backing plate 50, as shown in FIG. 1. Mounting flange 48 is bolted to upper master mount plate 18 and is a separate piece for each individual cutting/forming die 22, as shown in FIG. 2. This allows one or more dies 22 having upper and lower die sections 40, 42 to be mounted to master mount plates 18, 20. Backing ring 52 extends downwardly from mounting flange 48 to interconnect mounting flange 48 and backing plate 50. An insulating material 54 is positioned within backing ring 52 between mounting flange 48 and backing plate 50 to provide heat insulation for various die parts as described below.

Figure 3:
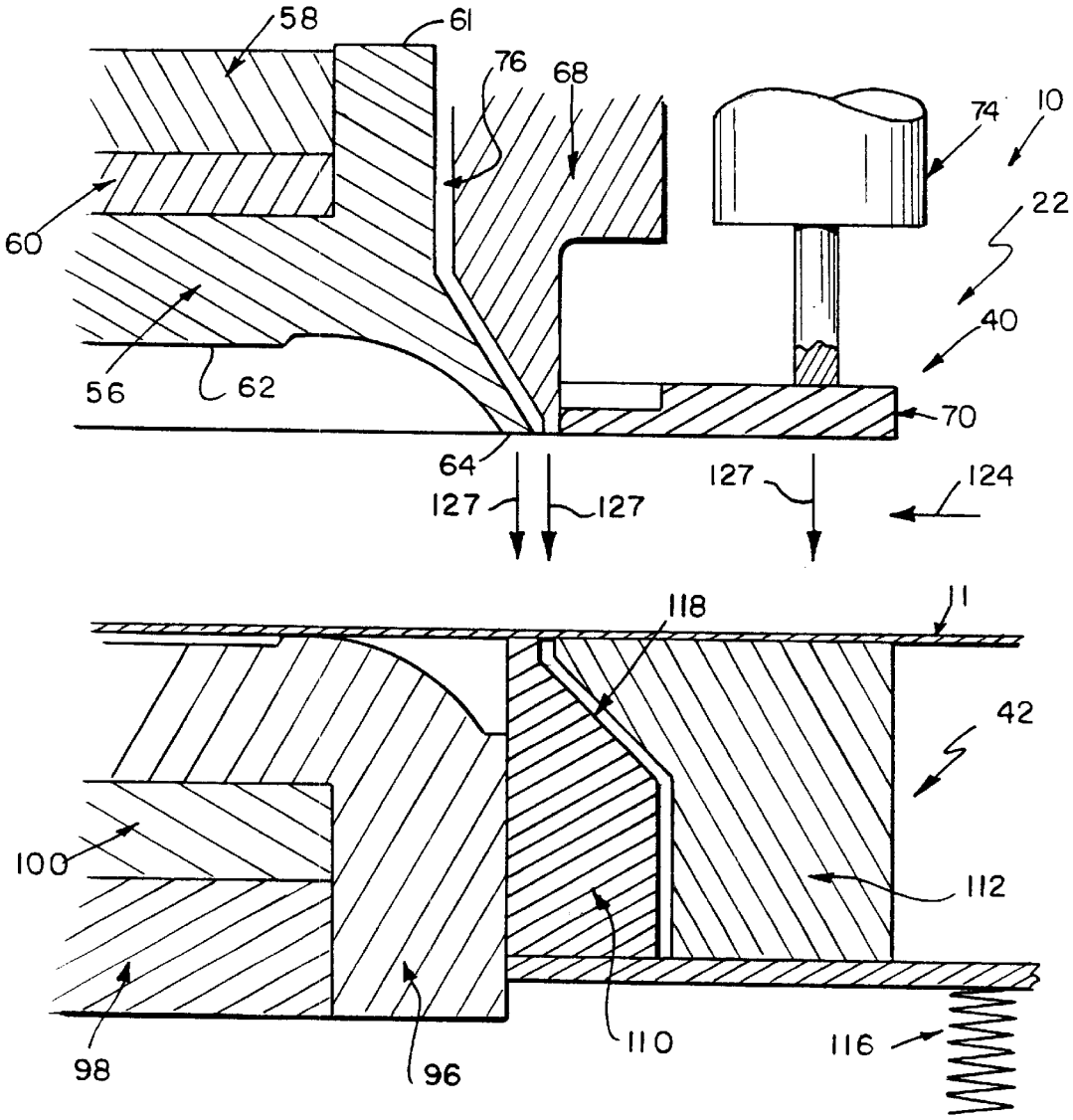
FIGS. 3–6 are enlarged views of a portion of the die system of FIGS. 1 and 2 showing the female and male die halves moving together to cut the piece of sheet stock to create the blank and forming the blank to create the container.

Each upper die section 40 also includes a first die half 56 mounted to backing plate 50, a heater retainer plate 58 mounted to backing plate 50 and positioned within first die half 56, and a heater 60 positioned within first die half 56 and mounted to backing plate 50. The first die half 56 is preferably a female die half, as shown in FIGS. 1 and 3, having an outer surface 61, a concave inner surface 62 for forming a container, and a perimetal surface 64 interconnecting outer surface 61 and inner surface 62. The outer surface 61 is formed to receive heater retainer plate 58 and heater 60, as shown in FIG. 3. The heater retainer plate 58 holds the heater 60 in position against first die half 56. The heater 60 is configured to heat first die half 56 to a temperature of 125° F. to 500° F. (51.67° C. to 260° C.) depending upon the type of container being formed and the type of sheet stock 11 being used.

Each upper die section 40 also includes a cutting punch 68 mounted to backing ring 52 and extending about first die half 56 and a stripper ring 70 coupled to backing ring 52 via a pair of pressure cylinders 72, 74 and extending about cutting punch 68. Cutting punch 68 is configured to cut the piece of sheet stock 11 to create a blank from the sheet stock 11 and stripper ring 70 is configured to hold the piece of sheet stock in place during the cutting and forming of the sheet stock 11 to create the container.

Cutting punch 68 is spaced apart from first die half 56 so that an air gap 76 minimizes or prevents heat from being transferred from heater 60 through first die half 56 to cutting punch 68 causing undesirable expansion and/or contraction of cutting punch 68 relative to first die half 56. In addition, the insulating material 54 positioned within backing ring 52 minimizes or prevents heat transfer from occurring between the female die half heater 60 and the upper parts of the die system 10, which would then transfer heat to cutting punch 68. This heat transfer is further thwarted by having backing ring 52 preferably be made from stainless steel which provides natural resistance to heat transfer while providing back up strength to cutting punch 68. Backing plate 50 may also be made of stainless steel to further reduce heat transfer and provide back up strength between the insulating material 54 and the female die half 56.

Stripper ring 70 is coupled to backing ring 54 using a pair of pressure cylinders 72, 74 (shown in FIG. 1) and a pair of retainer bolts 78,80 (shown in FIG. 2). Stripper ring 70 is configured to hold sheet stock 11 in place during cutting and forming of sheet stock 11 into one or more containers. Pressure cylinders 72, 74 are preferably air cylinders configured to urge stripper ring 70 downwardly in a controlled manner. However, pressure cylinders 72, 74 can also be any fluid cylinder, such as liquid or gaseous cylinders, or any other spring-like device for biasing stripper ring 70 downwardly.

Stripper ring 70 is held in position slightly below the level of the cutting punch 68 by stripper ring retainer bolts 78, 80 (shown in FIG. 2) and is urged downward by pressure cylinders 72, 74. The retainer bolts 78, 80 and pressure cylinders 72, 74 are held in place by pressure cylinder brackets 81, 82 and retainer bolt brackets 83, 84 (shown in FIGS. 1 and 2). All of these brackets 81, 82, 83, 84 are bolted to the stainless steel backing ring 52. The operation of stripper ring 70, cutting punch 68, and first die half 56 to cut and form the sheet stock into a container will be discussed in detail below.

Referring now to the lower die section 42 of each die 22, each lower die section 42 includes a mounting flange 88, a backing plate 90 spaced-apart from mounting flange 88, and a backing ring 92 interconnecting mounting flange 88 and backing plate 90, as shown in FIG. 1. Mounting flange 88 is bolted to lower master mount plate 20 and is a separate piece for each individual cutting/forming die 22, as shown in FIG. 2. Backing ring 92 extends upwardly from mounting flange 88 to interconnect mounting flange 88 and backing plate 90. An insulating material 94 is positioned within backing ring 92 between mounting flange 88 and backing plate 90 to provide heat insulation for various parts as described below.

Each lower die section 42 also includes a second die half 96 mounted to backing plate 90, a heater retainer plate 98 mounted to backing plate 90 and positioned within second die half 96, and a heater 100 positioned within second die half 96 and mounted to backing plate 90. The second die half 96 is preferably a male die half, formed to receive heater retainer plate 98 and heater 100, as shown in FIGS. 1 and 3. The heater retainer plate 98 holds the heater 100 in position against second die half 96. The heater 100 is configured to heat second die half 96 to a temperature of 125° F. to 500° F. (51.67° C. to 260° C.) depending upon the type of container being formed and the type of sheet stock 11 being used.

Each lower die section 42 also includes a draw ring 110 extending about second die half 96 and a cutting ring 112 extending about draw ring 110, as shown in FIGS. 1–3. Draw ring 110 is configured to cooperate with perimetal surface 64 of female die half 56, as described below, to hold the blank taut as the female and male die halves 56, 96 are mating to form the container. Cutting ring 112 is configured to cooperate with stripper ring 70 to hold the sheet stock 11 in place during the cutting and forming process and is configured to cooperate with cutting punch 68 to cut the blank from the sheet stock 11.

Draw ring 110 surrounds the male die half 96 and is held in position by narrow plates (not shown) extending through slots (not shown) in the cutting ring 112. As described in more detail below, draw ring 110 is configured to move downwardly and upwardly with female die half 56 relative to male die half 96 as the container is being formed to hold the blank of sheet stock in place during the forming process. Draw ring 110 is urged upwardly by pressure cylinders 114, 116 and the travel of draw ring 110 is limited by the slots in cutting ring 112. Pressure cylinders 114, 116 are similar to pressure cylinders 72, 74 and can be virtually any type of spring-like biasing member.

Cutting ring 112 is spaced apart from draw ring 110 to create an air gap 118 that minimizes or prevents heat from being transferred from heater 100 through second die half 96 to cutting ring 112 causing undesirable expansion and/or contraction of cutting ring 112 relative to second die half 96. In addition, the insulating material 94 positioned within backing ring 92 minimizes or prevents heat transfer from occurring between male die half heater 100 and the lower parts of die system 10, which would then transfer heat to cutting ring 112. This heat transfer is further thwarted by having backing ring 92 preferably be made from stainless steel which provides natural resistance to heat transfer while providing back up strength to cutting ring 112. Backing plate 90 may also be made of stainless steel to further reduce heat transfer and provide back up strength between the lower insulating material 94 and male die half 96.

Die system 10 of the present invention operates as shown in FIGS. 3–8 and described below. First, as shown in FIG. 3, a web (or multiple webs stacked one on top of each other) of sheet stock such as paperboard 11 is fed into die system 10 in a direction indicated by arrow 124 via a separate feeding mechanism or pull-off system associated with the press in which the die system is mounted. This web of paperboard 11 is positioned between upper and lower die sections 40,42 with paperboard 11 ultimately resting on cutting ring 112, draw ring 110 and male die half 96, as shown in FIG. 3. Then, depending upon the type of container being formed and the type of paperboard, female die half 56 and/or male die half 96 may be heated to a temperature of 125° F. to 500° F. (51.67° C. to 260° C.) via female die half heater 60 and/or male die half heater 100, respectively.

Figure 4:
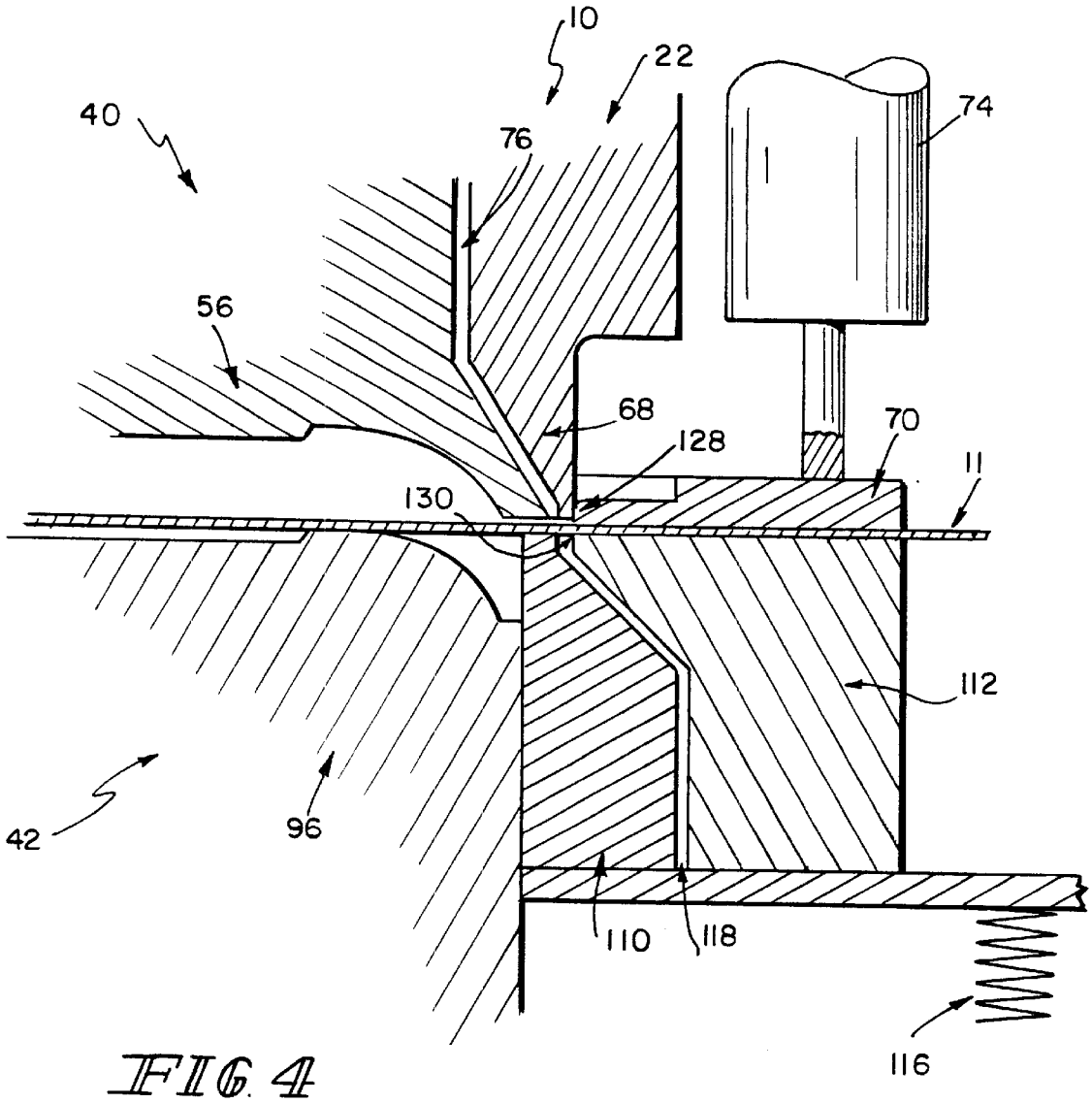
Figure 5:
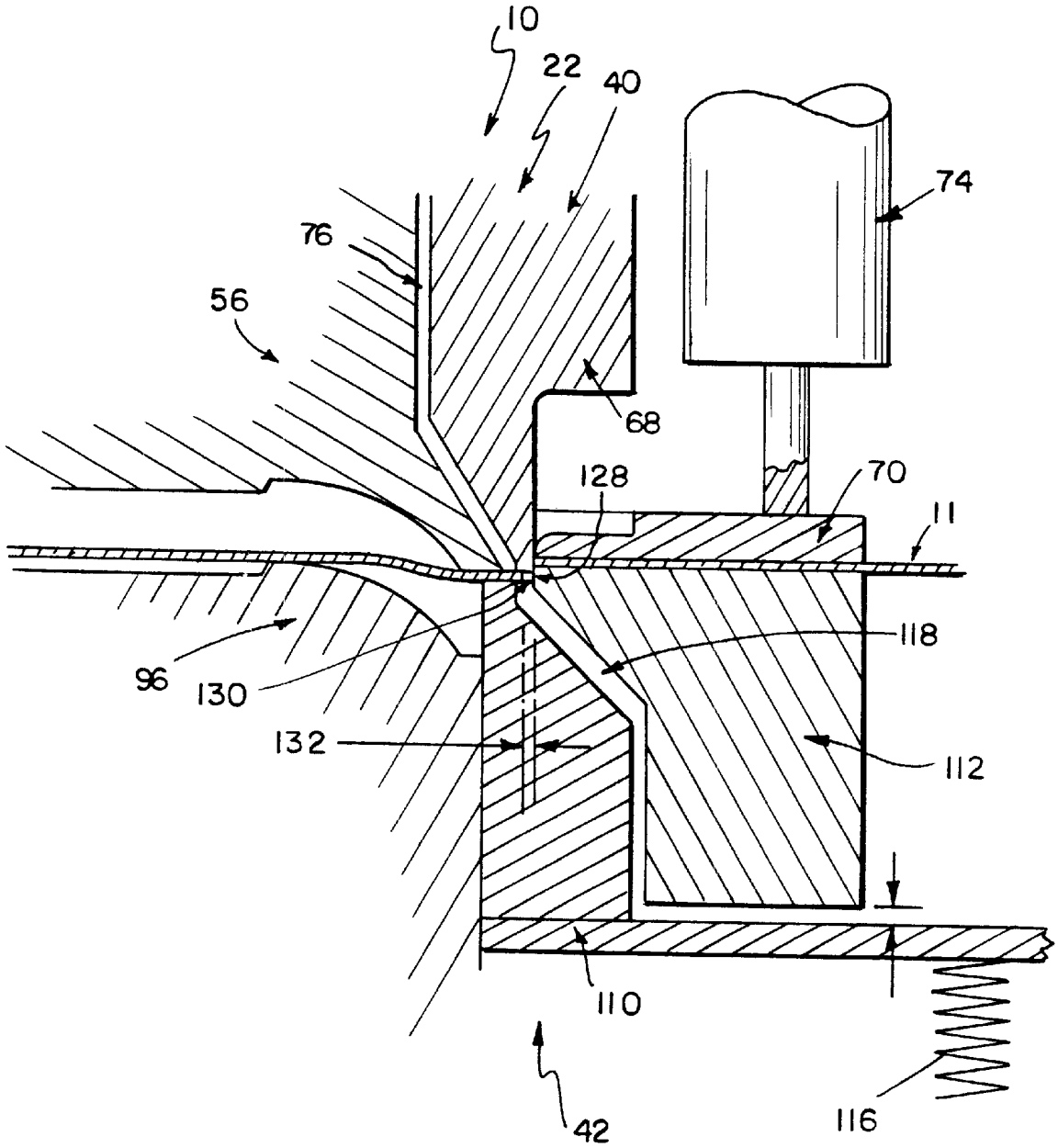

When paperboard 11 is in position, as shown in FIG. 3, a signal is given to die system 10 to begin the cycle. Upper die section 40 begins to descend in a direction indicated by arrows 127. As shown in FIG. 4, stripper ring 70 engages paperboard 11 first to secure paperboard 11 between stripper ring 70 and cutting ring 112. This prevents any movement of paperboard 11 during the cutting and forming process. Upper die section 40 continues to descend and within fractions of an inch (or fractions of a centimeter) cutting punch 68 begins to shear paperboard 11 between an outer edge 128 of cutting punch 68 and an inner edge 130 of cutting ring 112, as shown in FIG. 5. Inner edge 130 of cutting ring 112 may be ground in a very slight bevel to provide shear to this cutting action and to reduce the amount of force required to cut paperboard 11.

Figure 6:
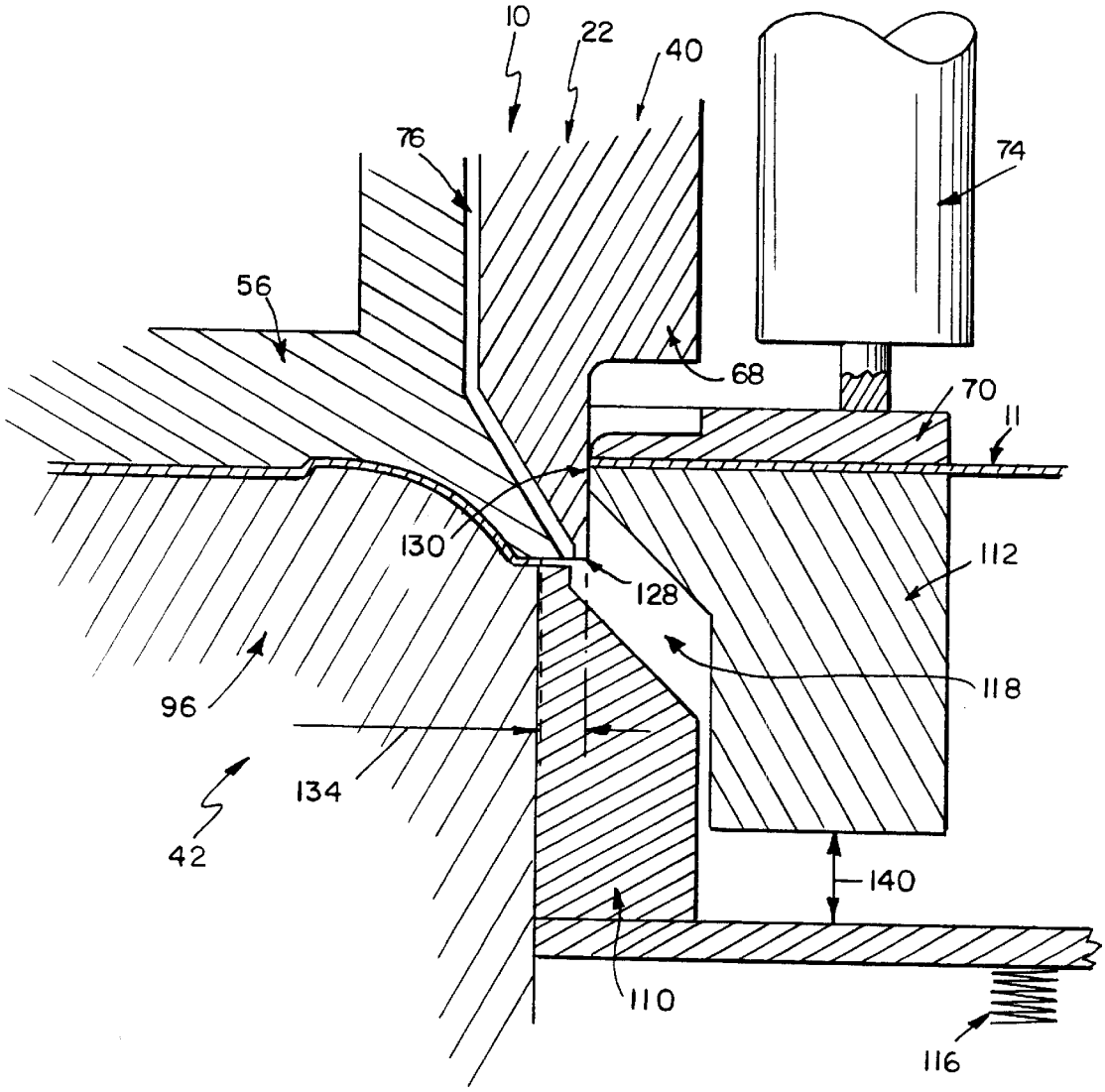

As upper die section 40 continues to descend after paperboard 11 is cut, perimetal surface 64 of female die half 56 holds the blank of paperboard 11 against draw ring 110, as shown in FIG. 5. Draw ring 110 is urged upwardly under pressure by pressure cylinders 114, 116 acting as springs and holding paperboard 11 tightly against perimetal surface 64 of female die half 56. This force of holding paperboard 11 between female die half 56 and draw ring 110 holds paperboard 11 taut as female die half 56 begins to form paperboard 11 over male die half 96, thereby preventing wrinkles in paperboard 11 from forming as the diameter of the blank is reduced as shown by distances 132, 134 in FIGS. 5 and 6, respectively. This force is adjustable by varying the pressure to the pressure cylinders 114, 116. If wrinkles are forming in the container, then the pressure can be increased. If the paperboard is tearing, then it is being held too tightly and the pressure can be reduced. While paperboard 11 is being cut and formed, stripper ring 70 and cutting ring 112 continue to hold paperboard 11 outside of the cutting edge. Stripper ring 70 is urged against paperboard 11 by stripper ring air cylinders 72, 74 which act as springs and compress as upper die section 40 descends, as shown in FIG. 6.

Because the paperboard is held in tension at all times during and after being cut, and is not transferred to another station for forming, there is no opportunity for misalignment of the blanks relative to die halves 56, 96 resulting in waste and jam-ups. In addition, because female die half 56 is pressed downwardly on male die half 96, the final product (such as a paper plate or container) is formed upside down which is preferable for ejection and stacking reasons, as discussed below.

Upper die section 40 continues to descend and female die half 56 continues to form the blank of paperboard over and around male die half 96. When the press reaches its maximum closed position, female die half 56 and male die half 96 have completely closed on paperboard 11, as shown in FIG. 6. In this position, female and male die halves 56, 96 hold the container under the tremendous force generated by die system 10 of approximately 6,000 lbs. to 16,000 lbs. per lane and draw ring 110 has moved a maximum distance 140 relative to cutting ring 112 and male die half 96. Die system 10 then dwells in this closed position for a time period of about ⅓ second to 1 second in order to allow the heat from the forming sections to iron the container into the shape of the die.

As the press begins to open back up, female die half 56 begins to lift off male die half 96. A very short burst of air may be directed through vent holes (not shown) in male die half 96 as soon as female die half 56 begins its ascent in order to ensure that the container releases from male die half 96. Because draw ring 110 is urged upwardly by air cylinders 114, 116 acting as springs, the upside-down container is lifted off male die half 96 by its flange which is still in contact with draw ring 110. The container flange is trapped between draw ring 110 and perimetal surface 64 of female die half 56. As draw ring 110 reaches the end of its travel, a very short blast of air may be directed through vent holes in inner surface 62 of female die half 56 to ensure the container stays on male die half 96 and does not follow female die half 56 up as it ascends further. At approximately the same time as female die half 56 releases contact with draw ring 110 through the container flange, stripper ring 70 releases paperboard web 11 which now has a hole 142 (shown in FIG. 7) cut in it from where the blank was cut.

Figure 7:
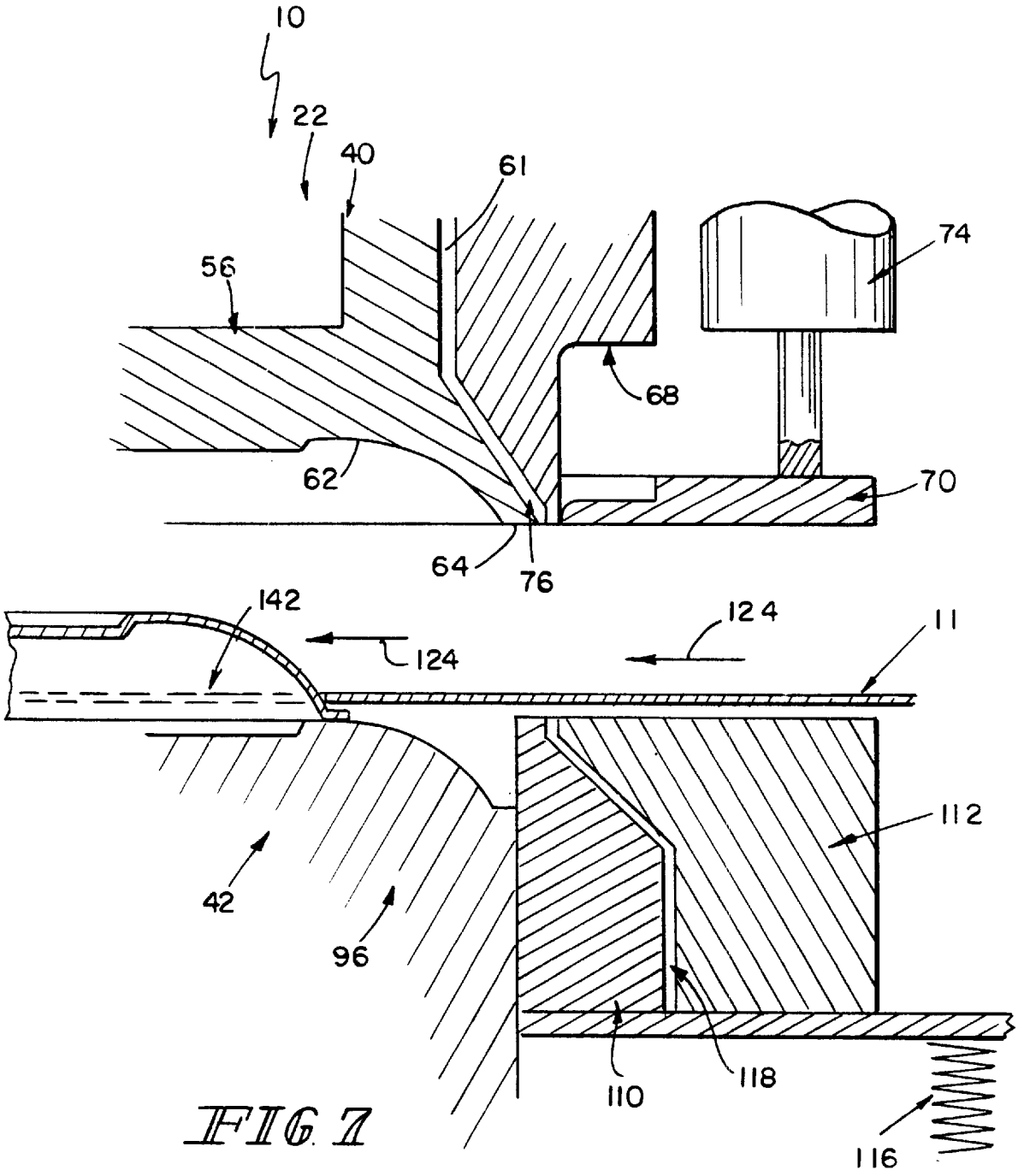
FIG. 7 is a view similar to FIGS. 3–6 showing movement of the female die half upwardly away from the male die half causing the container to be removed from between the female and male die halves so that the container is positioned within an opening formed in the piece of sheet stock as a result of the blank being cut from the piece of sheet stock and showing the container being moved by the piece of sheet stock as the sheet stock is advanced.
Figure 8:
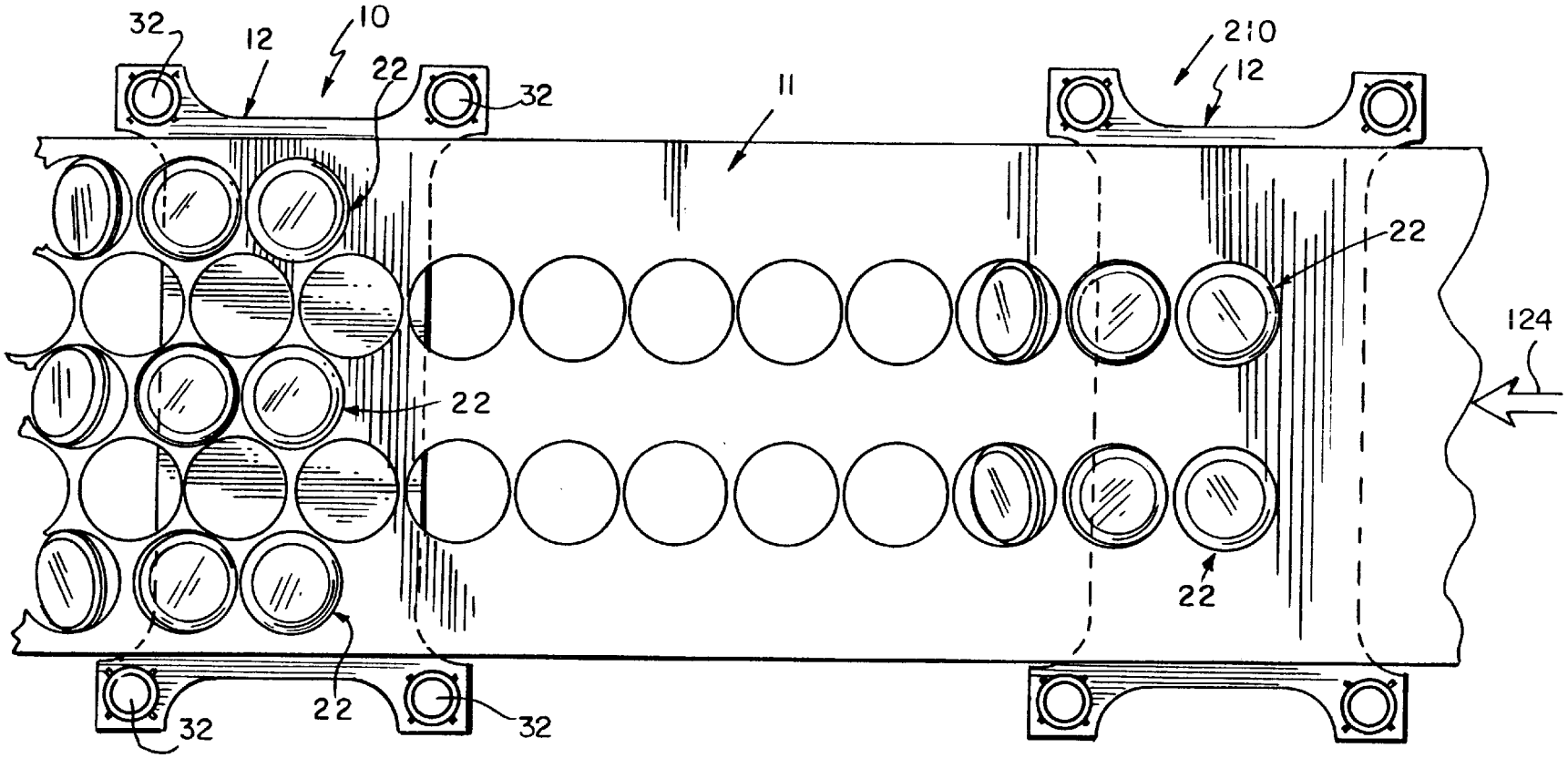
FIG. 8 is a sectional view taken along line 8—8 of FIG. 1 showing the die system of FIG. 1 being configured to cut and form three containers and showing a second die system located upstream from the die system of FIG. 1, the second die system being configured to cut and form two containers to minimize the amount of wasted sheet stock.

At this point in the cycle, the container is resting with its flange on draw ring 110 and paperboard web 11 is resting on top of cutting ring 112 as shown illustratively in FIG. 7. As soon as upper die section 40 has ascended far enough that female die section 56 has cleared the container bottom, the feed mechanism indexes the web. As paperboard web 11 is indexed, the leading edge is lifted somewhat, as shown in FIG. 7. A side wall defining hole 142 in the paperboard web where the blank was cut bumps into the container urging it forward. Near the end of the feed cycle, a brief blast of air is directed downwardly at an angle to the leading edge of the container. The container is directed in a downward path indicated by arrow 124 (FIG. 7) as the web of paperboard 11 is directed along a horizontal plane. This then allows the container to be separated from the web of paperboard by traveling through hole 142 in the web of paperboard 11 which is naturally larger than the formed container, as shown in FIG. 8. The container can then exit die system 10 downwardly through a product slide 150, shown in FIG. 9. As the containers exit die system 10, they are conveyed to another area of the machine where they are counted, stacked and presented to the operator for packaging.

Figure 9:
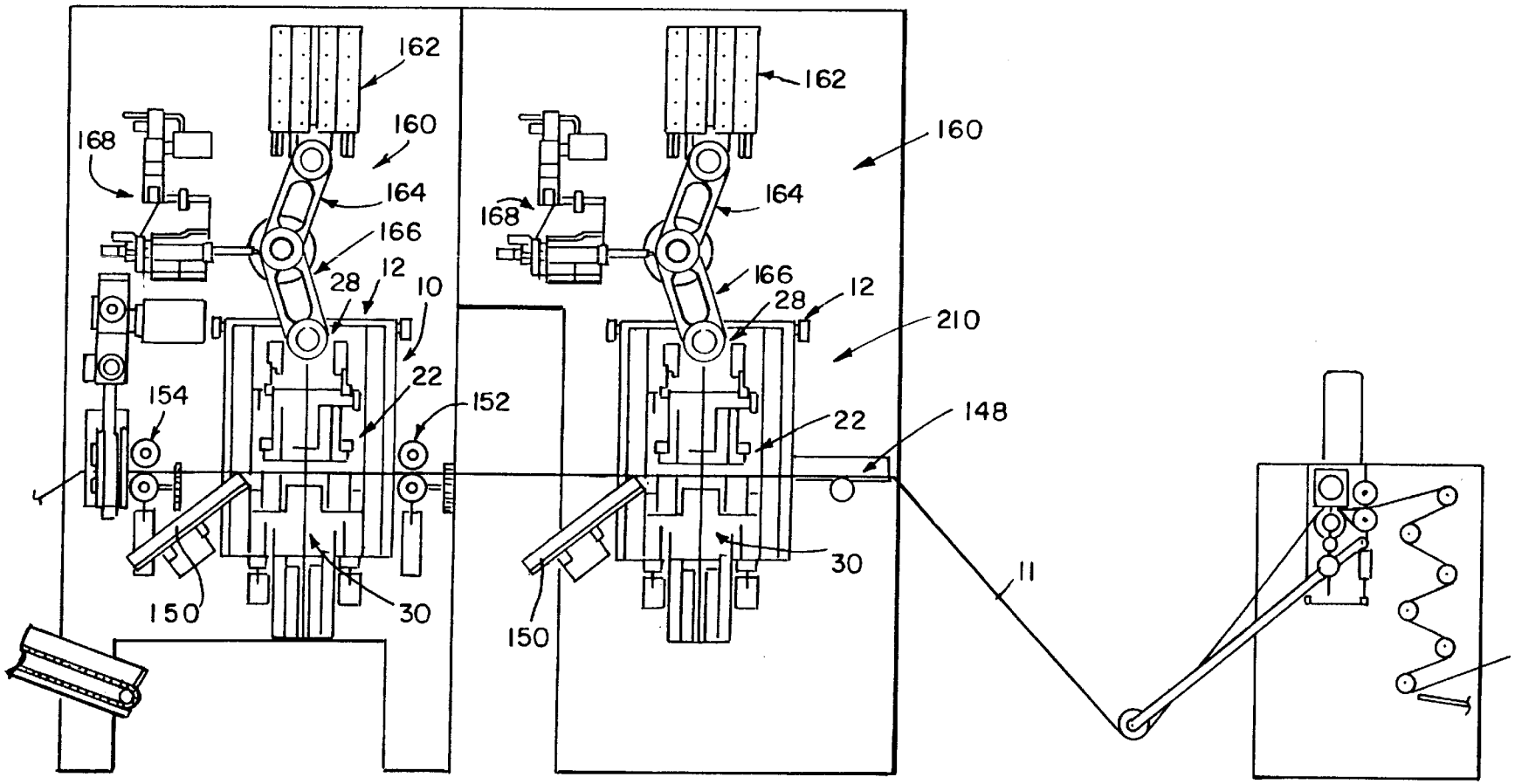
FIG. 9 is a side view of the two die systems of FIG. 8.

As shown in FIGS. 8 and 9, die system 10 may be combined with an upstream die system 210 positioned upstream from die system 10 (i.e., in a direction opposite feed direction 124). Die system 210 has two cutting/forming dies 22. As shown in FIG. 9, paperboard 11 first enters die system 210 through a web-guide system 148 so that two containers can be cut and formed using the two cutting/forming dies 22 of die system 210 shown in FIG. 8. Paperboard 11 is then indexed through an in-feed section 152 and into die system 10. Three more containers are cut and press-formed by the three cutting/forming dies 22 of die system 10 and the scrap skeleton of paperboard 11 then exits through an out-feed section 154. After out-feed section 154, the scrap paperboard is cut into pieces and discharged.

Although the current configuration shows two die systems 10, 210 having five cutting/forming dies 22, any combination of die systems and cutting/forming dies can be used to minimize the amount of scrap material that is produced and any shape container may be formed. The five cutting/forming dies 22 (three dies 22 of die system 10 and two dies 22 of second die system 210) are spaced to maximize the use of paperboard 11 so that waste is minimized, as shown in FIG. 8.

Two illustrative drive systems 160 for reciprocating upper die shoes 28 of die systems 10, 210 up and down relative to lower die shoes 30 of die systems 10, 210 is shown in FIG. 9. Each drive system 160 includes a mounting member 162, a first toggle 164, a second toggle 166, and a drive cylinder 168. Mounting member 162 is mounted to a beam 170 that is separate and spaced-apart from frame 12 of each die system 10, 210. First toggle 164 is coupled to mounting member 162 and to drive cylinder 168, as shown in FIG. 9. Second toggle 166 is coupled to upper die shoe 28 and to drive cylinder 168. Drive cylinder 168 reciprocates along a horizontal path so that first and second toggles 164, 166 move upper die shoe 28 up and down relative to lower die shoe 30, as shown illustratively in FIG. 9.

The die system of the present invention has fewer moving parts and simpler operation. It does not require double action press and both the cutting and forming steps are performed in a single press action. It requires shorter stroke press thereby conserving energy and component life. It has an adjustable die forming dwell time using hydraulic ram with less effect on output speeds. It also configures the dies in two groups or die systems to minimize paper scrap in round blank designs. It also configures one or more separate dies in two die systems minimizing press component size by a power of four (4) or more due to smaller required moment of inertiIa. In addition, die shoe temperature control allows broader material variance for more flexible part manufacturing. Also, independently adjustable die opening and closing speeds and part forming dwell times optimize output speeds. Furthermore, the container is blanked and formed in same location eliminating transfer problems and the dies are mounted on a flat, horizontal bed resulting in less wear on press and die parts. Finally, the dies are positively mounted so no misalignment can occur from jam ups.

Although the invention has been described in detail with reference to a certain illustrated embodiment, variations and modifications exist within the scope and spirit of the invention as described and as defined in the following claims.

What is claimed is:

1. A press system for cutting and forming a plurality of containers from sheet stock, the press system comprising:

first and second presses through which the sheet stock is fed in a feed direction, each press comprising a plurality of die systems for sequentially cutting the sheet stock to create a blank and forming the blank to create a separate container by each of said first and second presses, each die system comprising:

first and second mating die halves configured to move together to form the container from the blank, and a cutting punch extending about the first die half and movable therewith, the cutting punch being configured to cut the piece of sheet stock to create the blank, movement of the die halves together causing the cutting punch to cut the blank from the piece of sheet stock and further movement of the die halves together causing the first and second die halves to form the container from the blank the first press being positioned upstream from the second press and the die systems comprising the first press being positioned and arranged to cut blanks from the sheet stock in a first pattern and form the blanks into containers, leaving a modified web of sheet stock, the die systems comprising the second press being positioned and arranged to subsequently cut blanks from the modified web of sheet stock in a second pattern and form the blanks into containers whereby the first and second patterns are spaced to maximize the use of the sheet stock.

2. The apparatus of claim 1 further comprising an indexer and wherein the first press further comprises an out-feed section feeding the modified web of sheet stock to the indexer, and the second press further comprises an in-feed section fed the modified web of sheet stock by the indexer.

3. The apparatus of claim 2 wherein the indexer indexes the modified web of sheet stock to position the modified web of sheet stock so that blanks are cut from the modified web of sheet stock and formed into containers by the die system of the second press.

4. A press system for cutting and forming a plurality of containers from sheet stock consisting of material, the press system comprising:

a first press through which the sheet stock is fed comprising:

a plurality of die systems, each die system comprising:

first and second mating die halves configured to move together to form a container from a blank, and a cutting punch extending about the first die half and movable therewith, the cutting punch being configured to cut the sheet stock to create the blank leaving modified sheet stock, movement of the die halves together causing the cutting punch to cut the blank from the sheet stock and further movement of the die halves together causing the first and second die halves to form the container from the blank; and an out-feed system through which said modified sheet stock is fed, a second press comprising an in-feed system coupled to the out-feed system of the first press through which the modified sheet stock is fed and a plurality of die systems, each die system comprising:

first and second mating die halves configured to move together to form a container from a blank, and a cutting punch extending about the first die half and movable therewith, the cutting punch being configured to cut the modified sheet stock to create the blank leaving scrap skeleton sheet stock, movement of the die halves together causing the cutting punch to cut the blank from the modified sheet stock and further movement of the die halves together causing the first and second die halves to form the container from the blank; and wherein the first and second presses are designed and arranged to minimize the material in the scrap skeleton sheet stock.

5. The apparatus of claim 4 and further comprising an indexer receiving modified sheet stock from the out-feed system of the first press and feeding modified sheet stock to the in-feed system of the second press.

* * * * *